US009950775B1

(12) United States Patent
Chen

(10) Patent No.: US 9,950,775 B1
(45) Date of Patent: Apr. 24, 2018

(54) INFLATABLE LIFE VEST

(71) Applicant: Pacific Quest International, LLC, Richmond (CA)

(72) Inventor: Chun Chich Chen, San Jose, CA (US)

(73) Assignee: Pacific Quest International, LLC, San Jose, CA (US)

( * ) Notice: Subject to any disclaimer, the term of this patent is extended or adjusted under 35 U.S.C. 154(b) by 0 days.

(21) Appl. No.: 15/396,483

(22) Filed: Dec. 31, 2016

(51) Int. Cl.
*B63C 9/125* (2006.01)
*B63C 9/20* (2006.01)

(52) U.S. Cl.
CPC ..... *B63C 9/1255* (2013.01); *B63C 9/20* (2013.01)

(58) Field of Classification Search
CPC ..... B63C 9/1255; B63C 9/20
USPC ..... 441/106, 117
See application file for complete search history.

(56) References Cited

U.S. PATENT DOCUMENTS 3,046,576 A * 7/1962 Bernhardt ..... B63C 9/1255 441/118
4,060,867 A * 12/1977 Miller ..... B63C 9/1255 441/89
4,498,882 A * 2/1985 Evert ..... B63C 9/1255 441/107
4,917,641 A * 4/1990 Katoh ..... B63C 9/1255 441/115
5,494,469 A * 2/1996 Heath ..... B63C 9/1255 441/118
5,911,612 A * 6/1999 Steger ..... B63C 9/1255 441/116
6,605,050 B2 * 8/2003 Hansen ..... A61H 9/0078 601/41
6,805,519 B1 * 10/2004 Courtney ..... B63C 9/08 405/185
7,004,808 B1 * 2/2006 Nelson ..... B63C 9/1255 441/106
2004/0002270 A1 * 1/2004 Courtney ..... B63C 9/0005 441/40

* cited by examiner

*Primary Examiner* — S. Joseph Morano
*Assistant Examiner* — Jovon Hayes
(74) *Attorney, Agent, or Firm* — Eric Karich; Karich & Associates

(57) ABSTRACT

An inflatable life vest has first and second sheets that are welded together to form an inflatable compartment. The inflatable life vest further includes an elongate inflation chamber that extends upwardly from the inflatable compartment and towards a neck aperture. An inflation tube is connected to the elongate inflation chamber for inflating the inflatable life vest through the elongate inflation chamber. The vest may further include an indicator for indicating when the vest is fully inflated.

15 Claims, 4 Drawing Sheets

INFLATABLE LIFE VEST

BACKGROUND OF THE INVENTION

Field of the Invention

This invention relates generally to life vests, and more particularly to an inflatable life vest that may be manually inflated by blowing into an inflation tube.

Description of Related Art

The prior art teaches a variety of inflatable life vests. One common type of emergency life vest includes sheets of polymeric material that is formed into a generally U-shaped vest worn around the user's neck. This type of vest typically includes a compressed gas cylinder (CO2) for automatically inflating the vest in the event of an emergency.

Heath, U.S. Pat. No. 5,494,469, teaches this type of vest, which further includes an oral tube for blowing through the tube (and check valve) and into a U-shaped manifold which connects the various internal chambers of the vest. In this vest, the various chambers are each connected to the manifold via check valves, so that if one chamber is punctured, the other chambers will not deflate. While this construction is functional, it is fairly expensive to manufacture.

A disadvantage in the prior art is that the oral inflatable tube, which is used to blow into the vest for inflation, may be difficult to find and use by someone in an emergency situation. It is also difficult or impossible to use if the vest is inadvertently put on backwards. Another problem is the prior art vests tend to be too expensive to manufacture in the large numbers that may be required in some emergency situations.

The prior art teaches an emergency inflatable life vest that many be manually filled via an oral tube that is connected to a U-shaped manifold. However, the prior art does not teach an inflatable life vest wherein an inflation tube is connected to the vest via an elongate inflation chamber. The present invention fulfills these needs and provides further advantages as described in the following summary.

SUMMARY OF THE INVENTION

The present invention teaches certain benefits in construction and use which give rise to the objectives described below.

The present invention provides an inflatable life vest adapted to be worn by a person. The inflatable life vest is constructed of first and second sheets that are welded together to form an inflatable compartment. The inflatable life vest further includes an elongate inflation chamber that extends upwardly from the inflatable compartment and towards a neck aperture. An inflation tube is connected to the elongate inflation chamber for inflating the inflatable life vest through the elongate inflation chamber.

A primary objective of the present invention is to provide an inflatable life vest having advantages not taught by the prior art.

Another objective is to provide an inflatable life vest having an inflation tube connected to the vest via an elongate inflation chamber that properly locates the inflation tube near the person's mouth, and which may be easily used even if the vest is put on backwards.

A further objective is to provide an inflatable life vest that is inexpensive to manufacture.

A further objective is to provide an inflatable life vest that is easy to use in the event of an emergency, without training.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an inflatable life vest 10 that is adapted to be easily inflated by a person wearing the inflatable life vest 10, by blowing into an inflation tube 62. The inflatable life vest 10 is manufactured using first and second sheets 20 and 30 that are welded together in a manner that makes the inflatable life vest 10 inexpensive to manufacture. Furthermore, the inflation tube 62 is operably positioned on an elongate inflation chamber 50 so that the person can easily locate the tube 62 in emergency conditions and without training, and may inflate the inflatable life vest 10 even if the inflatable life vest 10 is put on backwards.

Figure 1:
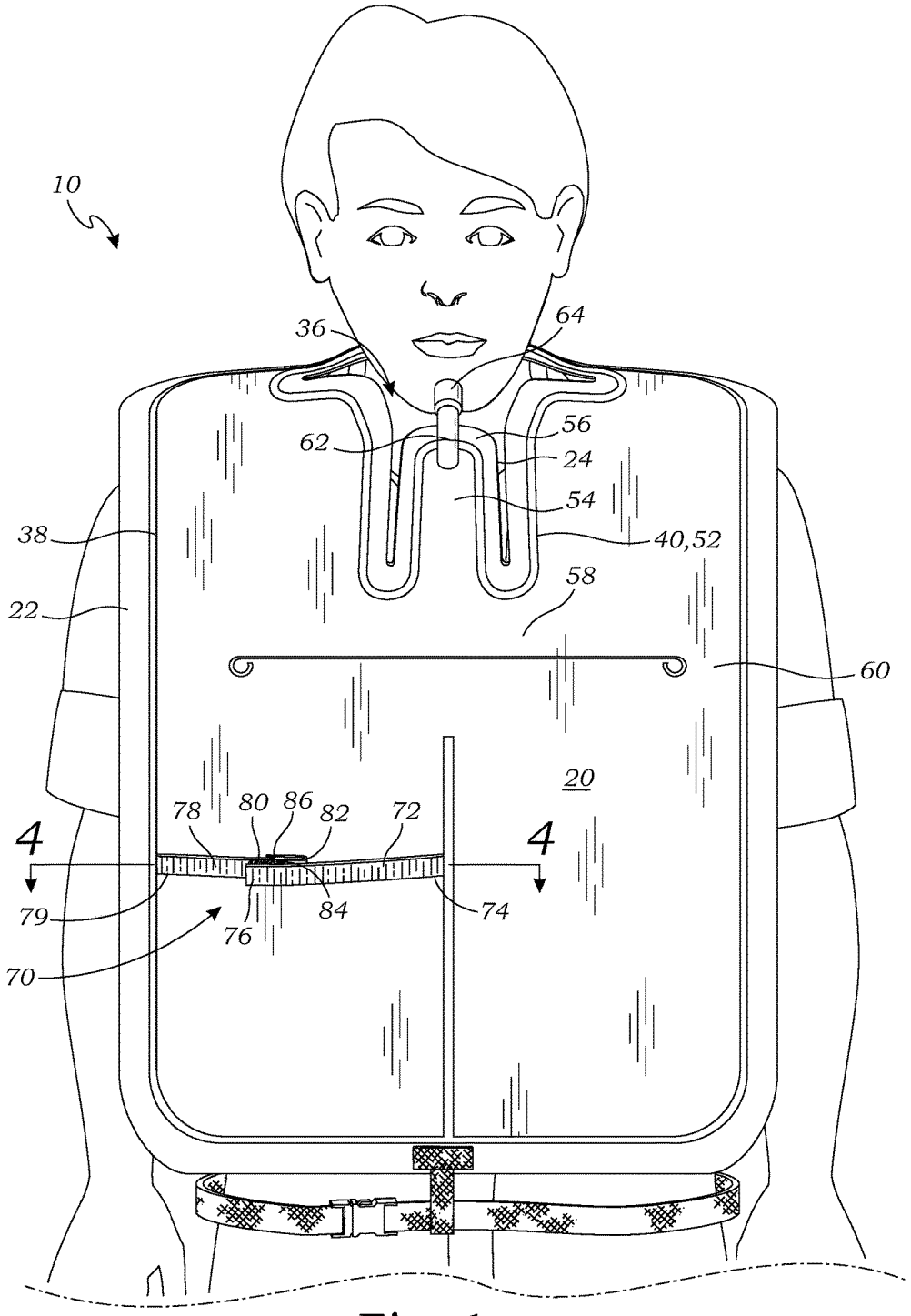
FIG. 1 is a perspective view of an inflatable life vest according to one embodiment of the present invention, illustrating the inflatable life vest being worn by a person in a deflated condition.
Figure 2:
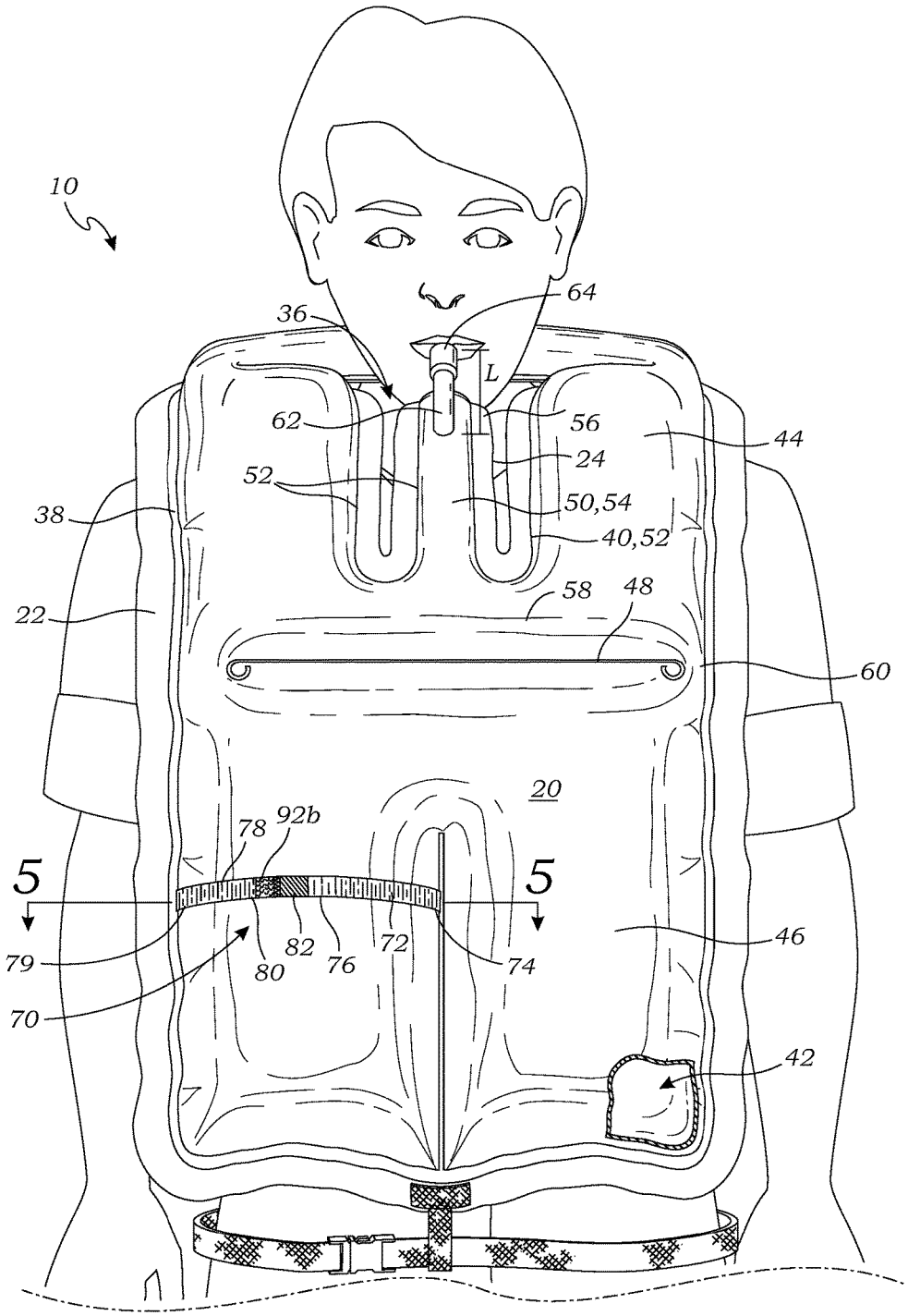
FIG. 2 is a perspective view thereof, illustrating the person blowing into an inflation tube and inflating the inflatable life vest to a properly inflated condition.
Figure 3:
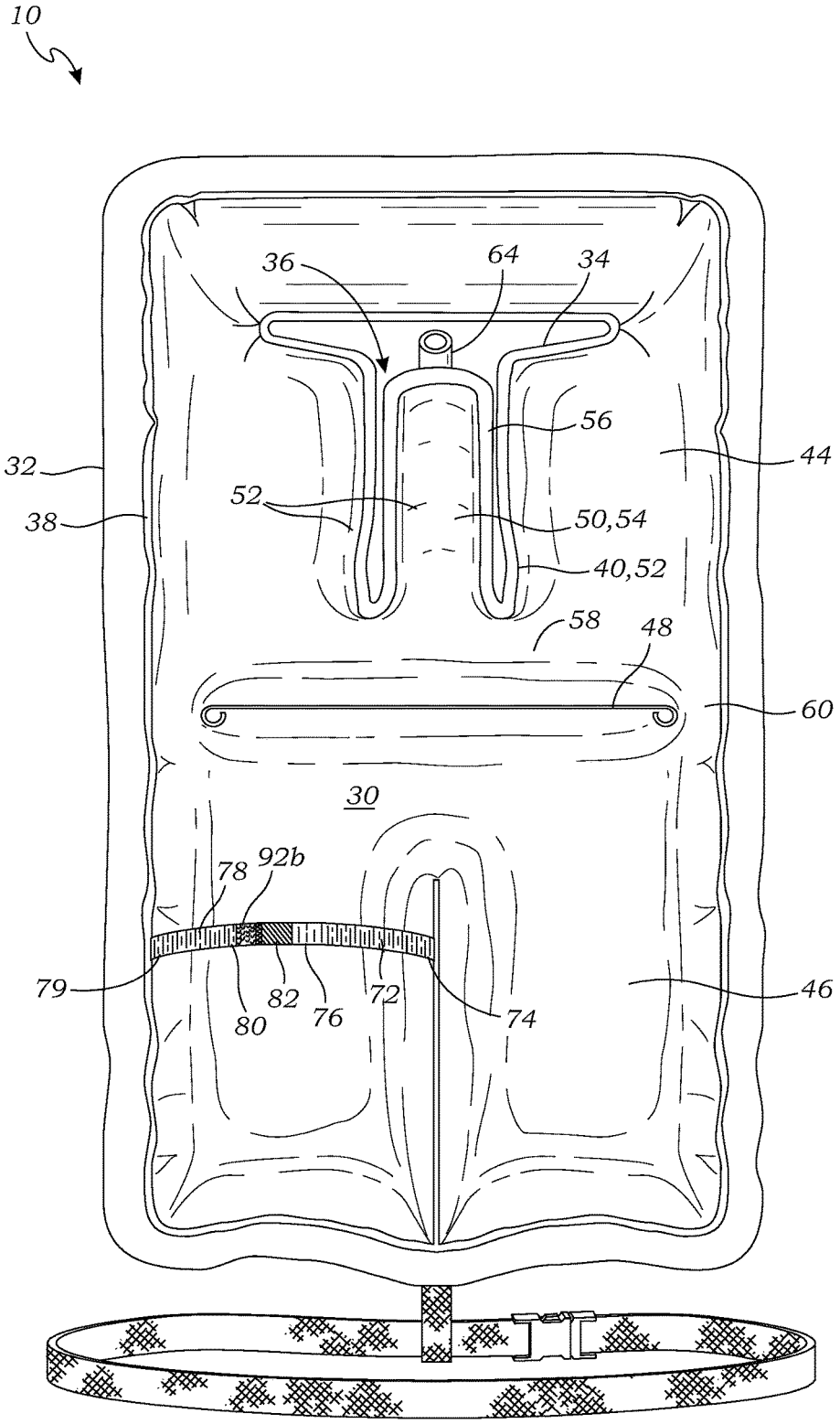
FIG. 3 is a rear perspective view of the inflatable life vest.

FIG. 1 is a perspective view of the person wearing one embodiment of the inflatable life vest 10, the inflatable life vest 10 being shown in a deflated condition. FIG. 2 is a perspective view illustrating the person blowing into an inflation tube 62 and inflating the inflatable life vest 10 to a properly inflated condition. FIG. 3 is a rear perspective view of the inflatable life vest 10 of FIG. 2.

As shown in FIGS. 1-3, the inflatable life vest 10 is adapted to be worn around a neck and over a chest of a person. The inflatable life vest 10 comprises a first sheet 20 (shown in FIGS. 1 and 2), and a second sheet 30 (shown in FIG. 3). The first sheet 20 has an outer perimeter 22 and an inner perimeter 24, and the second sheet 30 similarly has an outer perimeter 32 and an inner perimeter 34. In the present embodiment, the sheets 20 and 30 are cut in an identical (or very similar) pattern so that they may be welded together, as described in more detail below. The inner perimeters 24 and 34 together form a neck aperture 36 that is shaped to fit around the neck of the person. While we discuss the use of two sheets 20 and 30, these sheets may be formed from a single sheet and connected in at least some portions, and then folded over to form a front and a back; and alternatively, the vest 10 could also be formed of multiple pieces of material that are connected together; and such alternative embodiments should be considered within the scope of the terminology claimed in the present invention.

In the present embodiment, an outer weld connects together the outer perimeter 22 of the first sheet 20 and the outer perimeter 32 of the second sheet 30. For purposes of this application, the term "weld" is defined to include any form of welding (e.g., heat welding), as well as equivalent bonding or connecting methods know in the art (e.g., adhesives, mechanical fasteners, etc.), so long as an airtight seal is provided.

Similarly, an inner weld 40 connects the inner perimeter 24 of the first sheet 20 and the inner perimeter 34 of the second sheet 30, to form an inflatable compartment 60 (shown in FIG. 2) between the first and second sheet 20 and 30 and the outer and inner welds 38 and 40. In this embodiment, the inflatable compartment 42 has a generally U-shaped construction that includes a neck surrounding chamber 44 that extends partially around the neck of the person when worn, and a front chamber 46 that is positioned in front of the person when worn.

As shown in FIGS. 1-3, the inflatable life vest 10 further includes an elongate inflation chamber 50 that extends upwardly from the inflatable compartment 42 and towards the neck aperture 36. In this embodiment, the elongate inflation chamber 50 is sealed by a generally W-shaped weld 52 that forms a portion of the inner weld 40. In this embodiment, the elongate inflation chamber 50 includes a tubular body 54 that is tubular in construction, and which may have a round cross section, although other shaped cross sections may be used in alternative embodiments (e.g., square, oval, other). The elongate inflation chamber 50 extends to a closed upper end 56 that is located proximate to but below the person's mouth when worn.

The inflation tube 62 is mounted to the elongate inflation chamber 50 for inflating the inflatable life vest 10 through the elongate inflation chamber 50. The inflation tube 62 of this embodiment, is a semi-rigid tube that is fixedly attached to a closed end of the elongate inflation chamber 50. When the elongate inflation chamber 50 is inflated, it becomes semi-rigid (i.e., it is self-supporting, but can be readily bent as required for use), and the inflation tube 62 is similarly semi-rigid (being constructed of a suitable flexible plastic, rubber, synthetic, or rubber-like material known in the art for this type of tube), so that the two together support the inflation tube 62 adjacent (and slightly below) the person's mouth, for ease of inflation (even without training).

The inflation tube 62 has a check valve 64 for preventing air in the inflatable life vest 10 from escaping the elongate inflation chamber 50. The inflation tube 62 also has a length L that is great enough so that the inflation tube 62 extends further into the neck aperture 36 than closed upper end 56 of the elongate inflation chamber 50. This enables the inflation tube 62 to be easily accessed, even if the inflatable life vest 10 is inadvertently put on backwards.

In the embodiment of FIGS. 1-3, the inflatable life vest 10 further comprises a central lateral weld 48 that extends at least partially across the inflatable life vest 10 to separate the neck surrounding chamber 44 from the front chamber 46. The central lateral weld 48 is spaced from the generally W-shaped weld 52 of the elongate inflation chamber 50 by a space 58 that enables air from the elongate inflation chamber 50 to flow into the neck surrounding chamber 44. The central lateral weld 48 is also spaced from the outer perimeter 22 by side spaces 60 that enable air from the elongate inflation chamber 50 to flow into the front chamber 46.

Figure 4:
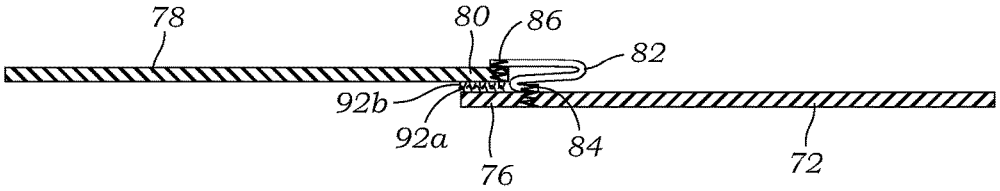
FIG. 4 is a sectional view thereof taken along line 4-4 in FIG. 1.
Figure 5:
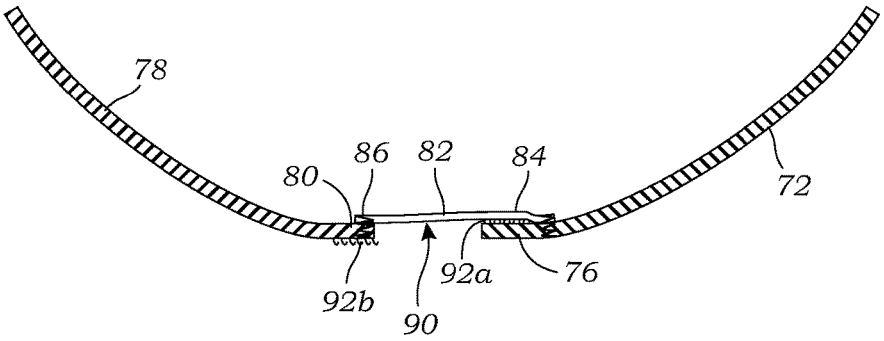
FIG. 5 is a sectional view thereof taken along line 5-5 in FIG. 2.

FIG. 4 is a sectional view thereof taken along line 4-4 in FIG. 1. FIG. 5 is a sectional view thereof taken along line 5-5 in FIG. 2. As shown in FIGS. 1, 2, 4, and 5, in this embodiment, the inflatable life vest 10 further includes an indicator 70 for indicating when the inflatable compartment 42 is inflated to a predefined volume that is suitable for helping to keep the person afloat (without rupturing the inflatable life vest 10). In this embodiment, the indicator 70 is in the form of a means for indicating when inflation is complete. In this embodiment, the means for indicating 70 includes a pair of straps, including a first strap 72 having an outer end 74 and an inner end 76; and a second strap 78 having an outer end 79 and an inner end 80. Each of the outer ends 74 and 79 are connected (e.g., sewn, welded, or otherwise fastened) to the first sheet 20 in two locations. The inner ends 76 and 80 each include fasteners 92*a* and 92*b* (e.g., hooks and loops such as Velcro®, or any other suitable fastener, such as snaps, etc.) which can interconnect to removably join the inner ends 76 and 80. An indicator strip 82 having a first end 84 and a second end 86 may also be included, with the first end 84 being attached to the inner end 76 of the first strap 72, and the second end 86 being attached to the inner end 80 of the second strap 78.

As shown in FIGS. 1 and 4, the fasteners 92*a* and 92*b* are initially connected together when the inflatable life vest 10 is in a deflated condition, but the two fasteners 92*a* and 92*b* are pulled apart when the inflatable life vest 10 is inflated to a properly inflated condition. As shown in FIGS. 2 and 5, when the fasteners 92*a* and 92*b* are pulled apart, the indicator strip 82 becomes visible, thereby indicating that the inflatable life vest 10 is fully inflated and should not be inflated any further. A top surface 90 of the indicator strip 82 may be colored, textured, printed, or otherwise adapted to give a strong visual signal. The indicator strip 82 itself may be a bright color (or printed with a bright color) to indicate visually that the vest 10 is inflated (e.g., red, to indicate that the person should stop further inflation). The indicator strip 82 may further include other options, such as printed text (e.g., instructions to stop inflation), or other indicia or elements.

In other embodiments, other means for indicating 70 may be used. For example, a strap may completely surround a portion of the inflatable life vest 10 such that expansion of the inflatable life vest 10 causes the strap to break, change colors or confirmation, pull on another element, or otherwise physically change or cause a change that readily indicates to the person that the inflatable life vest 10 is fully inflated. In other embodiments, a pressure sensor (physical, or electronic) could cause an indication (e.g., an audible and/or visual indication, etc.) that alerts the user, or stops the further inflation. These options are provided as examples, and the scope of the present invention further includes alternative systems and methods for providing an indication that the inflatable life vest 10 is fully inflated.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. An inflatable life vest adapted to be worn around a neck and over a chest of a person, the inflatable life vest comprising:

first and second sheets, each having an outer perimeter and an inner perimeter, the inner perimeter forming a neck aperture that is shaped to fit around the neck of the person;

an outer weld that connects together the outer perimeters of the first and second sheets, and an inner weld that connects together the inner perimeters of the first and second sheets, to form an inflatable compartment between the first and second sheets and the outer and inner welds;

an elongate inflation chamber that extends upwardly from the inflatable compartment and towards the neck aperture;

an inflation tube connected to the elongate inflation chamber for inflating the inflatable life vest through the elongate inflation chamber, the inflation tube having a check valve; and wherein the elongate inflation chamber is sealed by a generally W-shaped weld that forms a portion of the inner weld.

2. The inflatable life vest of claim 1, wherein the inflatable compartment including a neck surrounding chamber that extends partially around the neck of the person when worn, and a front chamber that is positioned in front of the person when worn.

3. The inflatable life vest of claim 2, further comprising a central lateral weld that extends at least partially across the inflatable life vest to separate the neck surrounding chamber from the front chamber.

4. The inflatable life vest of claim 3, wherein the elongate inflation chamber is sealed by a generally W-shaped weld that forms a portion of the inner weld.

5. The inflatable life vest of claim 4, wherein the central lateral weld is spaced from the generally W-shaped weld of the elongate inflation chamber by a space that enables air from the elongate inflation chamber to flow into the neck surrounding chamber.

6. The inflatable life vest of claim 5, wherein the central lateral weld is spaced from the outer perimeter by side spaces that enable air from the elongate inflation chamber to flow into the front chamber.

7. The inflatable life vest of claim 1, wherein the inflation tube has a length that is great enough so that the inflation tube extends further into the neck aperture than an upper end of the elongate inflation chamber.

8. The inflatable life vest of claim 1, further comprising a means for indicating when the inflatable compartment is inflated to a predefined volume that is suitable for helping to keep the person afloat.

9. The inflatable life vest of claim 8, wherein the means for indicating comprises:

a first strap having an outer end and an inner end;

a second strap having an outer end and an inner end;

wherein each of the outer ends are connected to the first sheet;

fasteners attached to the inner ends which are interconnected to removably join the inner ends;

an indicator strip having a first end and a second end, with the first end of the indicator strip being attached to the inner end of the first strap, and the second end of the indicator strip being attached to the inner end of the second strap; and wherein the fasteners are initially connected together when the inflatable life vest is in a deflated condition, but the two fasteners are pulled apart when the inflatable life vest is inflated to a properly inflated condition, such that the indicator strip becomes visible, thereby indicating that the inflatable life vest is fully inflated.

10. The inflatable life vest of claim 1, wherein the elongate inflation chamber includes a tubular body.

11. The inflatable life vest of claim 10, wherein the elongate inflation chamber extends to a closed upper end that is located proximate to but below the person's mouth when worn.

12. The inflatable life vest of claim 11, wherein the elongate inflation chamber has a round cross section.

13. An inflatable life vest adapted to be worn around a neck and over a chest of a person, the inflatable life vest comprising:

first and second sheets, each having an outer perimeter and an inner perimeter, the inner perimeter forming a neck aperture that is shaped to fit around the neck of the person;

an outer weld that connects together the outer perimeters of the first and second sheets, and an inner weld that connects together the inner perimeters of the first and second sheets, to form an inflatable compartment between the first and second sheets and the outer and inner welds;

the inflatable compartment including a neck surrounding chamber that extends partially around the neck of the person when worn, and a front chamber that is positioned in front of the person when worn;

an elongate inflation chamber that extends upwardly from the inflatable compartment and towards the neck aperture, the elongate inflation chamber being sealed by a generally W-shaped weld that forms a portion of the inner weld;

an inflation tube connected to the elongate inflation chamber for inflating the inflatable life vest through the elongate inflation chamber, the inflation tube having a check valve for preventing air in the inflatable life vest from escaping the elongate inflation chamber, and the inflation tube having a length that is great enough so that the inflation tube extends further into the neck aperture than an upper end of the elongate inflation chamber; and a means for indicating when the inflatable compartment is inflated to a predefined volume that is suitable for helping to keep the person afloat.

14. The inflatable life vest of claim 13, wherein the means for indicating comprises:

a first strap having an outer end and an inner end;

a second strap having an outer end and an inner end;

wherein each of the outer ends are connected to the first sheet;

fasteners attached to the inner ends which are interconnected to removably join the inner ends;

an indicator strip having a first end and a second end, with the first end of the indicator strip being attached to the inner end of the first strap, and the second end of the indicator strip being attached to the inner end of the second strap; and wherein the fasteners are initially connected together when the inflatable life vest is in a deflated condition, but the two fasteners are pulled apart when the inflatable life vest is inflated to a properly inflated condition, such that the indicator strip becomes visible, thereby indicating that the inflatable life vest is fully inflated.

15. An inflatable life vest adapted to be worn around a neck and over a chest of a person, the inflatable life vest comprising:

first and second sheets, each having an outer perimeter and an inner perimeter, the inner perimeter forming a neck aperture that is shaped to fit around the neck of the person;

an outer weld that connects together the outer perimeters of the first and second sheets, and an inner weld that connects together the inner perimeters of the first and second sheets, to form an inflatable compartment between the first and second sheets and the outer and inner welds;

an elongate inflation chamber that extends upwardly from the inflatable compartment and towards the neck aperture;

an inflation tube connected to the elongate inflation chamber for inflating the inflatable life vest through the elongate inflation chamber, the inflation tube having a check valve; and wherein the inflation tube has a length that is great enough so that the inflation tube extends further into the neck aperture than an upper end of the elongate inflation chamber.

* * * * *